US010358884B2

(12) United States Patent
Rogers

(10) Patent No.: US 10,358,884 B2
(45) Date of Patent: Jul. 23, 2019

(54) METHOD AND APPARATUS FOR IMPROVING CEMENT BOND OF CASING IN CYCLIC LOAD APPLICATIONS

(71) Applicant: Halliburton Energy Services, Inc., Houston, TX (US)

(72) Inventor: Henry Eugene Rogers, Oklahoma City, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/566,539

(22) PCT Filed: May 19, 2015

(86) PCT No.: PCT/US2015/031545
§ 371 (c)(1),
(2) Date: Oct. 13, 2017

(87) PCT Pub. No.: WO2016/186655
PCT Pub. Date: Nov. 24, 2016

(65) Prior Publication Data

US 2018/0283115 A1 Oct. 4, 2018

(51) Int. Cl.
*E21B 33/14* (2006.01)
*E21B 23/01* (2006.01)
*E21B 43/12* (2006.01)

(52) U.S. Cl.
CPC ..... *E21B 23/01* (2013.01); *E21B 33/14* (2013.01); *E21B 43/124* (2013.01)

(58) Field of Classification Search
CPC ..... E21B 33/14; E21B 21/10; E21B 23/01; E21B 2034/007; E21B 34/12; E21B 34/14; E21B 43/26
See application file for complete search history.

(56) References Cited

U.S. PATENT DOCUMENTS 3,976,139 A * 8/1976 Wilder ..... E21B 23/00 166/285
4,538,442 A 9/1985 Reed
(Continued)

FOREIGN PATENT DOCUMENTS

CA 2837250 A1 11/2012
JP 59080818 A * 5/1984 ..... E02D 5/808

OTHER PUBLICATIONS

International Search Report and Written Opinion issued in related PCT Application No. PCT/US2015/031545 dated Feb. 17, 2016, 19 pages.

(Continued)

*Primary Examiner* — Zakiya W Bates
(74) *Attorney, Agent, or Firm* — John W. Wustenberg; Baker Botts L.L.P.

(57) ABSTRACT

An apparatus and method for pre-loading a production casing string being cemented to a section of surface casing and wellbore disposed below the surface casing is provided. The apparatus includes an anchor which is secured to a bottom-hole section of the parent casing string. The production casing string is connected to the anchor. Pulling on the anchor puts the production casing string in tension. The anchor includes a lock sleeve and a wedge which secures the arms of the lock sleeve in recesses formed within the inner surface of the parent casing string when the rig pulls on production casing string connected to the anchor thereby setting the anchor in the bottom-hole section of the parent casing string. The bottom-hole section of the parent casing string is formed with ribs which enhance bonding of the parent casing string to the cement between the parent casing string and wellbore.

8 Claims, 5 Drawing Sheets

(56) References Cited

U.S. PATENT DOCUMENTS

| | | | | |
|---|---|---|---|---|
| 9,238,952 | B2 | 1/2016 | Rogers et al. | |
| 2005/0023000 | A1* | 2/2005 | Warren | E21B 21/10 166/380 |
| 2006/0032640 | A1 | 2/2006 | Costa et al. | |
| 2008/0087418 | A1 | 4/2008 | Cook et al. | |
| 2012/0298380 | A1 | 11/2012 | Rogers et al. | |

OTHER PUBLICATIONS

International Preliminary Report on Patentability issued in related PCT Application No. PCT/US2015/031545, dated Nov. 30, 2017, 10 pages.

Office Action issued in related Canadian application No. 2978273 dated Aug. 16, 2018 (6 pages).

* cited by examiner

METHOD AND APPARATUS FOR IMPROVING CEMENT BOND OF CASING IN CYCLIC LOAD APPLICATIONS

CROSS-REFERENCE TO RELATED APPLICATION

The present application is a U.S. National Stage Application of International Application No. PCT/US2015/031545 filed May 19, 2015, which is incorporated herein by reference in its entirety for all purposes.

TECHNICAL FIELD

The present disclosure relates generally to downhole cementing applications, and, more particularly, to an improved method and apparatus for bonding casing to a subterranean formation in cyclic load applications.

BACKGROUND

Hydrocarbons, such as oil and gas, are commonly obtained from subterranean formations that may be located onshore or offshore. The development of subterranean operations and the processes involved in removing hydrocarbons from a subterranean formation typically include a number of different steps such as, for example, drilling a wellbore at a desired well site, treating the wellbore to optimize production of hydrocarbons, and performing the necessary steps to produce and process the hydrocarbons from the subterranean formation.

Certain subterranean reservoirs contain hydrocarbons, which are difficult to produce because they are highly viscous. Tar sand formations are one example of such a reservoir. One common technique for recovering oil and gas from such subterranean reservoirs is to inject them with steam. The steam makes the hydrocarbons less viscous thereby making them easier to produce through conventional production casing or tubing. There are several different methods for injecting steam into the formation. One such manner is simple injection of steam into a wellbore and producing from a nearby or adjacent wellbore. The other is by use of a Huff & Puff well. A Huff & Puff well has the advantage of simply requiring a single well and thereby avoids the cost and expense of drilling multiple wells.

A drawback, however, of Huff & Puff wells, and other steam injection wells is that the wide temperature and pressure variations that are generated through the steam injection process and subsequent cooling of the well to allow production to flow puts stress on the cement bonds that are formed between the casing string and the wellbore. This is because the casing string itself expands and contracts in response to the temperature and pressure variations. Over time, this expansion and contraction of the casing string can result in a failure of the bond formed between the casing string and the wellbore, which can be detrimental to the structural integrity of the well and to the hydraulic seal formed by the cement.

Studies have found that if the casing string is pre-stressed, for example, by being put under tension prior to cementing to the wellbore, it can better withstand the wide temperature and pressure swings that occur with the steam injection process. This is because the pre-stressing of the casing string limits the expansion and contraction that occurs with the temperature and pressure swings.

One technique that has been developed to pre-tension the casing string involves employing two different types of cement slurries, each having different set times. The first step in this process is to pump the slurry having the longer set time, known as the lead slurry, down the casing string after it has been installed in the wellbore and back up the annulus formed between the casing string and the wellbore. The next step is to pump the slurry with the shorter set time, known as the tail slurry, behind the lead slurry. The tail slurry is pumped down the casing string and back up the annulus. It is placed along the bottom portion of the annulus, for example, along the bottom 500 feet in a 2,000-foot well. Once the tail slurry sets, rigidly securing the bottom portion of casing string to the formation, then the rig pulls up on the top of the casing string, the casing string is thereby put into tension. Slips are then set at the surface to hold the casing string in tension as the lead slurry sets. Once both slurries have set, the casing string remains bonded in place under tension.

While this technique puts the casing string in a pre-stressed condition and thereby minimizes the cement bond failures that would otherwise occur without pre-loading, it has the drawback of requiring the rig to remain idle while the tail slurry sets. This results in lost rig time of approximately 5 hours or more for each cement job performed. In fields having hundreds or thousands of wells, this can be quite costly for the well operator.

The present disclosure is directed to a method and apparatus that seeks to pre-stress the casing string while minimizing the costly rig time required with current pre-tensioning techniques.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Figure 1:
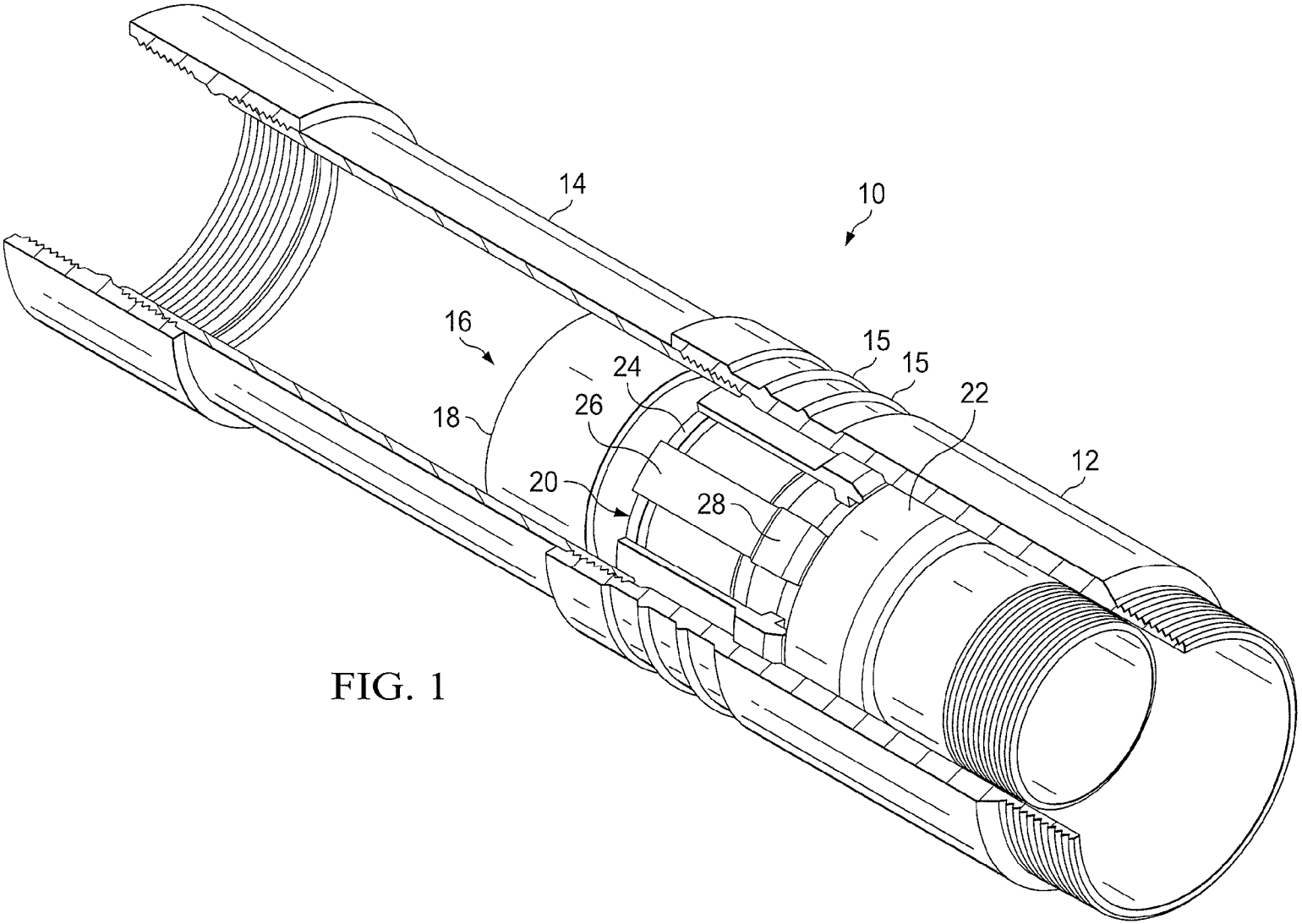
FIG. 1 is a partial cut-away view of a section of parent casing and a casing anchor collar disposed therein with a tension set casing anchor disposed within the casing anchor collar in accordance with the present disclosure.

Turning to FIG. 1, a bottom-hole section of the parent and inner casing string to be cemented to the wellbore formed in a subterranean formation is shown generally by reference numeral 10. The surface casing or pipe, which is the outer casing typically run into the upper section of the well bore, has a casing collar 12 secured to a section of parent casing 14 at the bottom-hole section of the surface casing or pipe. The casing collar 12 is designed to match the casing size, weight, grade and thread of the parent casing 14. The casing collar 12 has a profile formed on its inner surface which is adapted to receive and engage with a casing anchor 16 for use in putting the inner casing, also known as the production casing or pipe, in tension. The production casing or pipe is smaller in diameter and runs from the surface at the rig to the very bottom of the well bore. It connects above and below to the casing anchor 16 via threaded connections. The production casing is nested within the surface casing or pipe 14 through the upper section of the wellbore. It is the casing that is to be placed in tension in connection with the present disclosure. It is ultimately cemented to the surface or parent casing 14 in the upper section of the well bore and to the well bore itself in the lower regions of the well. On its outer surface, the casing collar 12 has a plurality of ribs 15. The ribs 15 enable the casing collar 12 to function in much the same way that rebar functions in steel-reinforced concrete. It enhances the bonding and anchoring of the surface casing to the cement formed in the annulus (not shown) between the surface casing and wellbore.

The casing anchor 16 is formed of a number of different components, including a main body 18, which is a generally tubular-shaped member formed of a steel alloy having the same general size, weight, grade and thread as the casing string. As those or ordinary skill in the art will appreciate, the outer diameter of the main body 18 is smaller than the inner diameter of the casing collar 12 and parent casing 14 to allow the casing anchor 16 to travel down the interior of the surface casing. The casing anchor 16 also includes a lock sleeve 20, which is slidably installed on the main body 18. The casing anchor 16 further includes a lock sleeve wedge 22, which is slidably installed on the main body 18 adjacent to the lock sleeve 20. The wedge 22 supports the lock sleeve 20 as it engages the casing anchor collar 14. The lock sleeve 20 and wedge 22 are also formed of a steel alloy having the same general size, weight, and grade as the production casing.

Figure 2:
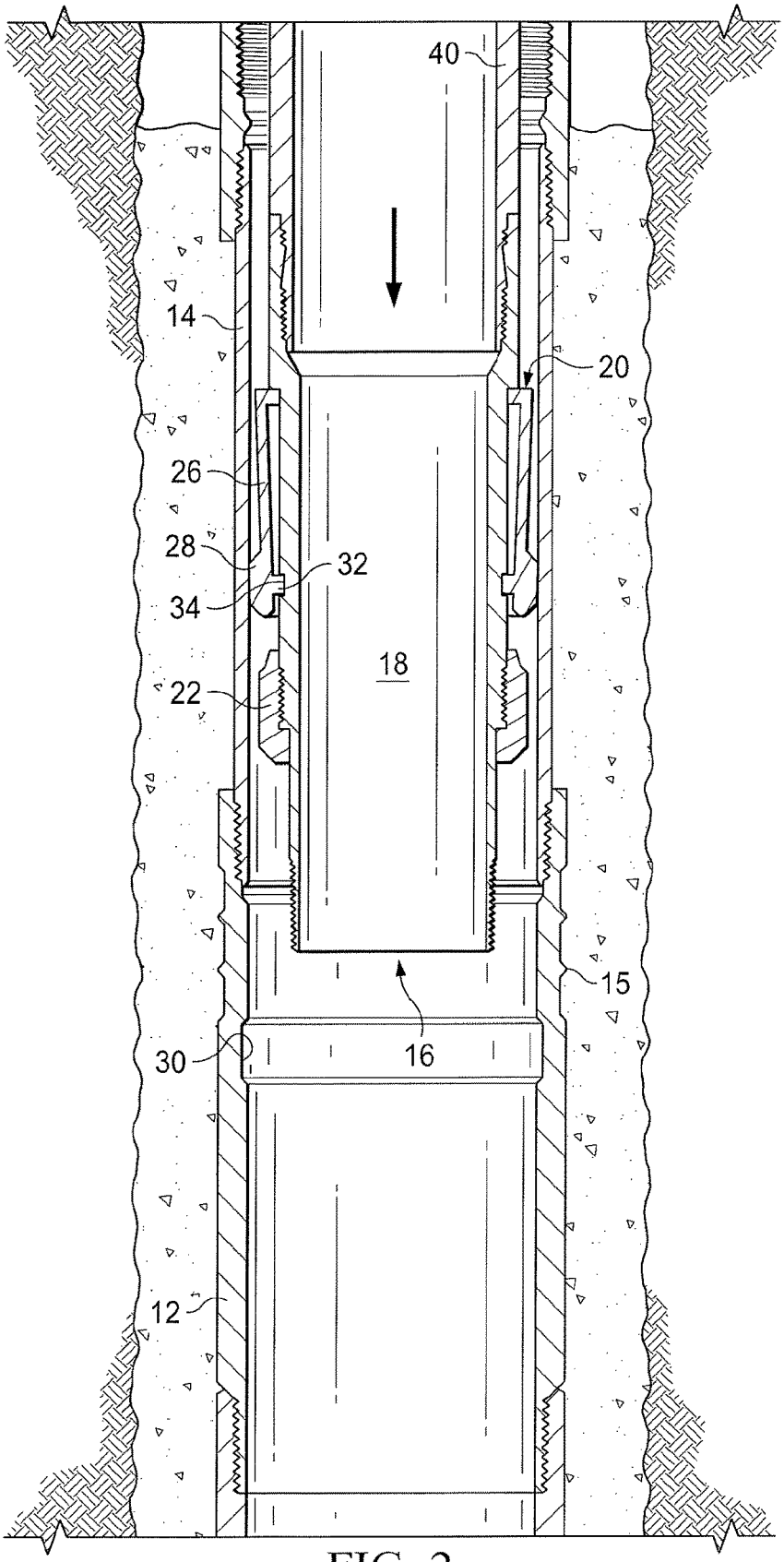
FIG. 2 is a partial cut-away view along the longitudinal direction of the tension set casing anchor of FIG. 1 being run in the parent casing.

In one embodiment, the lock sleeve 20 has a generally spider-like shape. It is defined by a generally circular ring 24 having a plurality of arms 26 projecting therefrom. In one exemplary embodiment, there are eight arms 26 projecting from, and equally-spaced around, the generally circular ring 24. The plurality of arms 26 are generally flexible at least in the radial direction, such that they may be placed in compression when the casing anchor 16 is deployed downhole into the surface casing. Each of the arms 26 has an end or tip 28 which has opposing tapered surfaces, as better illustrated in FIGS. 2-4. The tapered surfaces of the tips 28 enable the tips to engage within one or more recesses 30 formed within the inner surface of the casing collar 12 during the step of securing the casing anchor 18 to the casing collar 12. The tips 28 of the arms 26 of the lock sleeve 20 also have a flange 32 formed on the surface of the tip opposite the opposing tapered surfaces. The flanges 32 rest within one or more recesses 34 formed on the outer circumferential surface of the main body 18 of the casing anchor 16 when the casing anchor is being deployed down the surface casing just prior to being secured within the casing collar 12.

Figure 4:
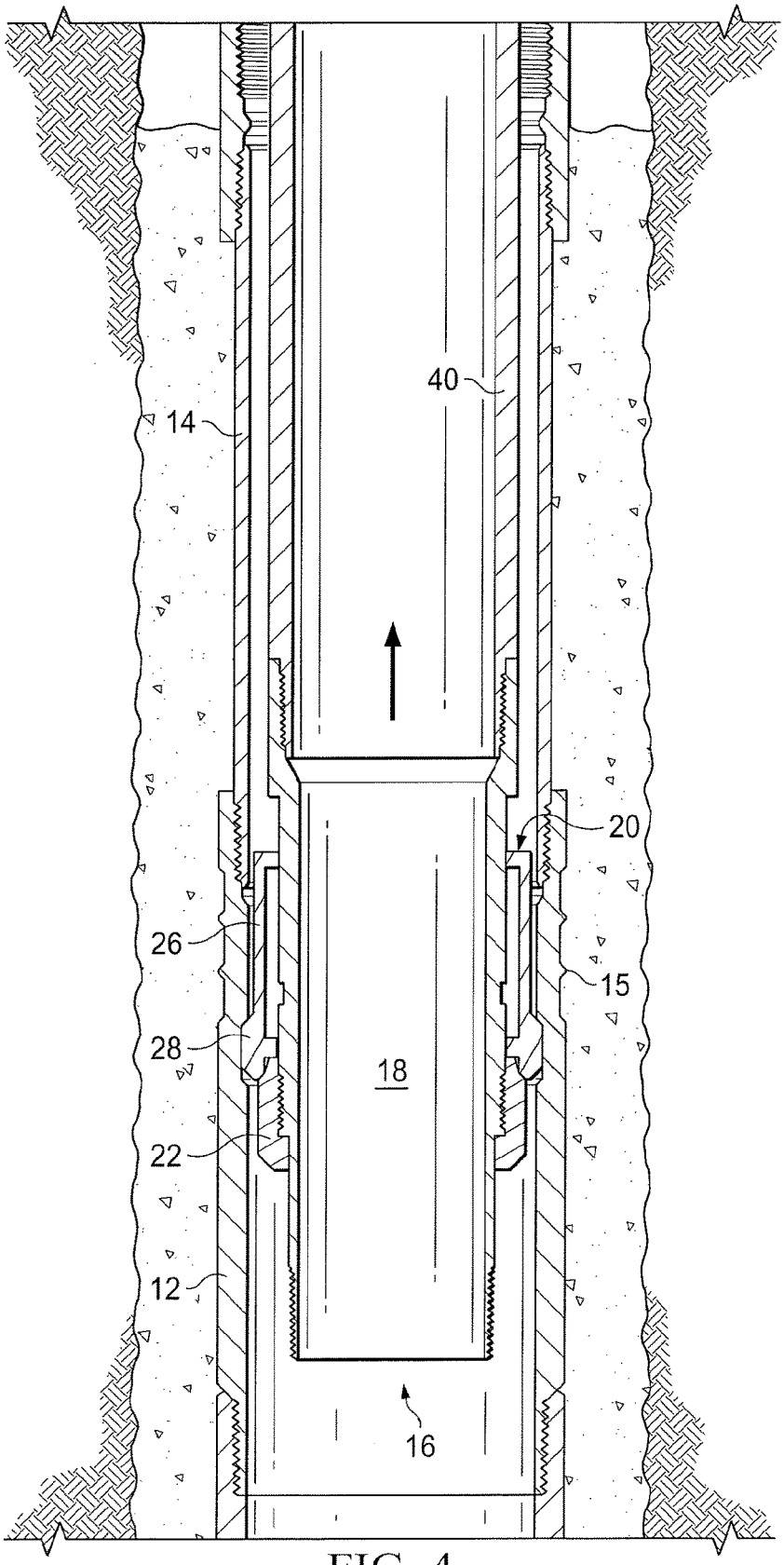
FIG. 4 is a partial cut-away view along the longitudinal direction of the tension set casing anchor of FIG. 1 shown in the anchored position within the casing anchor collar whereby the parent casing can be placed under tension.

The wedge 22 is a generally ring-shaped member and functions to wedge the tapered tips 28 of the lock sleeve arms 26 into the recesses 30 formed in the inner surface of the casing collar 12 when the work string pulls up on the casing anchor 16 once it has been set in the casing collar 12, as shown in FIG. 4. The wedge 22 forces one of the opposing tapered surfaces of the tips 28 of the lock sleeve into a complementary tapered surface in the recess 30. In one embodiment, the tapered surfaces of the tips 28 and complementary surface in the recess 30 are formed at a 45 degree angle. The lodging of the wedge 22 into the tips 28 of the lock sleeve arms 26 locks the casing anchor 16 into the casing collar 12, thereby enabling the rig to pull on the production casing string and thereby place the production casing string in tension.

Figure 3:
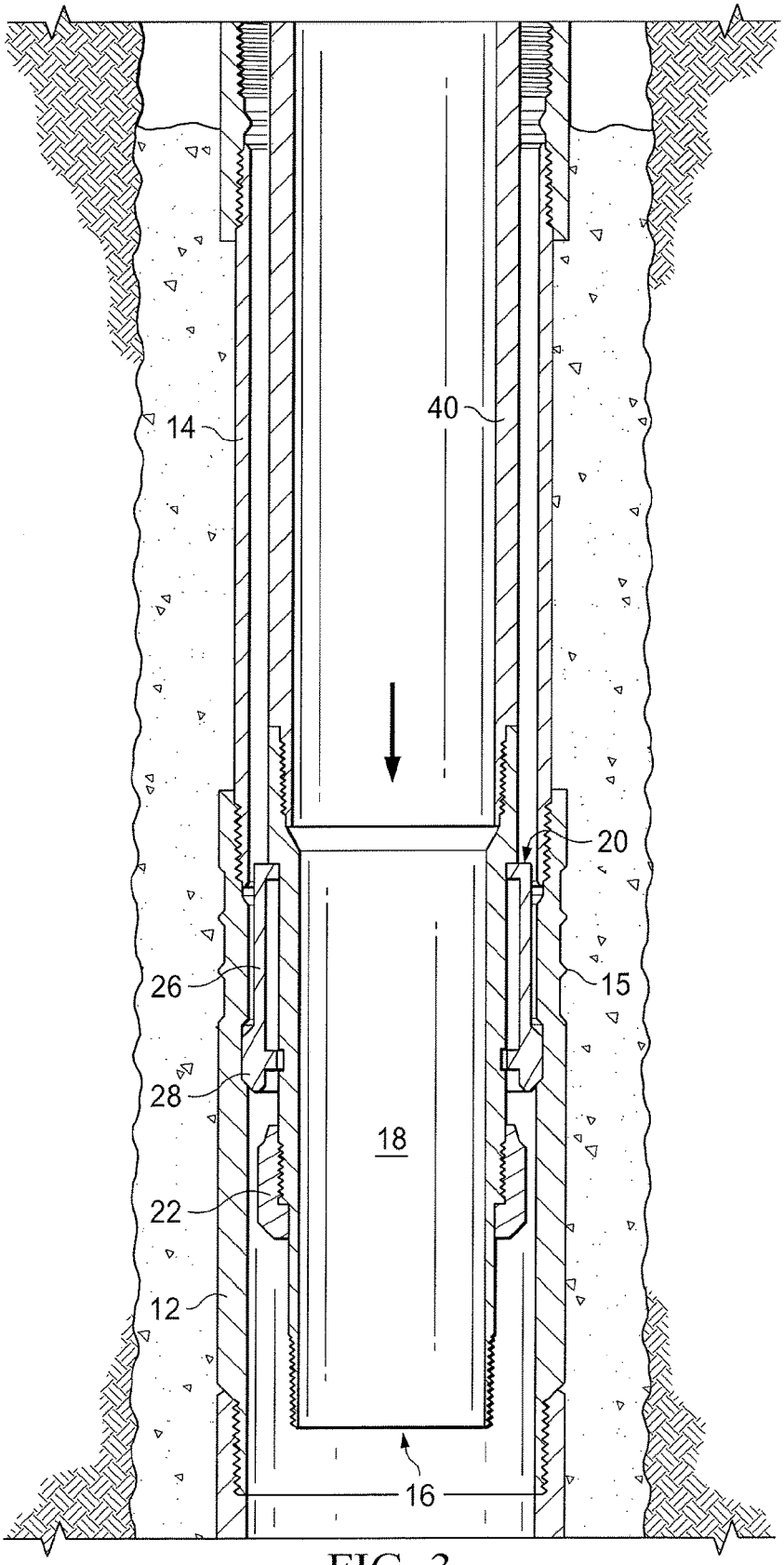
FIG. 3 is a partial cut-away view along the longitudinal direction of the tension set casing anchor of FIG. 1 shown engaged with a casing anchor collar.
Figure 5:
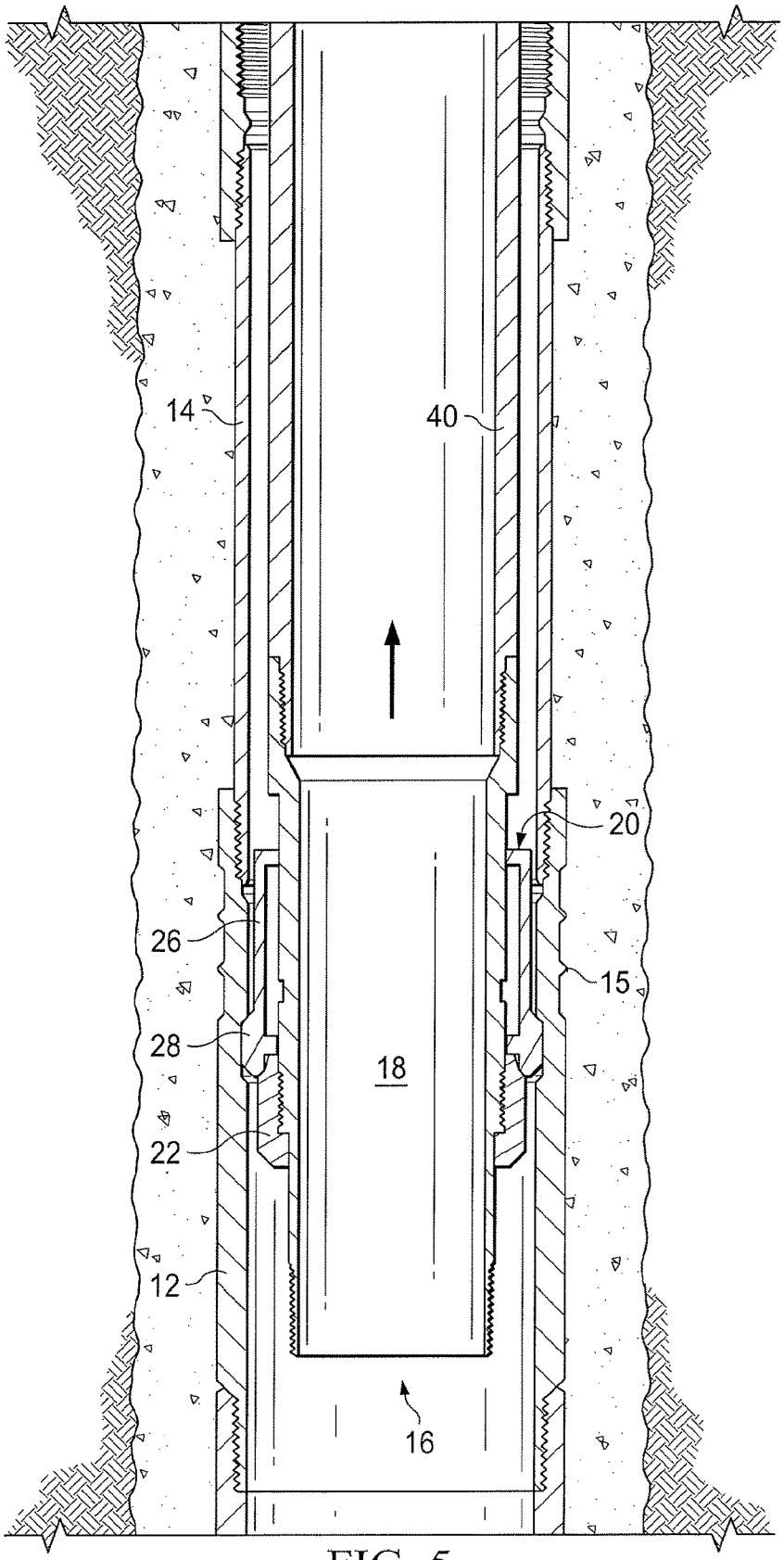
FIG. 5 is a cross-sectional view of the casing liner installed within the wellbore illustrating the setting of the casing anchor.

The present disclosure is also directed to a method for cementing a production casing string to the surface casing and well bore. The method includes landing the production casing string 40 in the surface casing 14, as shown in FIGS. 3-5. The method also includes deploying the casing anchor 16 into the bottom-hole section of the surface casing string, and more specifically, into the casing collar 12. The casing anchor 16 is delivered proximate the recesses 30 formed in the inner surface of the casing collar 12 such that the arms 26 of the locking sleeve 20 spring into the recesses 30. The production casing string 40 is then pulled upwards forcing the wedge 22 into the locking sleeve 20 thereby locking the arms 26 into the recesses 30.

With the casing anchor 16 set, the rig is able to put the casing string in tension. Slips can be set at the surface to maintain the production casing string 40 in tension while the production casing string is being cemented to the surface casing 14 and wellbore. The production casing string 40 above the slips can be detached from the rest of the casing once the slips have been set, thereby enabling the rig to be deployed to another well, which can save valuable rig time and money for the well operator. Once the production casing string has been placed in tension, cement slurry can be pumped down the bore of the production casing string and up into the annulus formed between the production casing string 40 and the surface casing 14 and wellbore below the surface casing 14. The cement slurry then can be allowed to set while the production casing string 40 is under tension. This acts to preload the casing string and thereby minimize its expansion and contraction during large swings in downhole temperature and pressure, which are common in a number of well types, including, for example, Huff & Puff wells.

Once the cement bond has formed between the production casing string 40 and the surface casing 14 and wellbore below the surface casing, further well operations, such as perforation, gravel packing, zonal isolation, etc., may be performed on the well.

Although the present disclosure and its advantages have been described in detail, it should be understood that various changes, substitutions and alterations can be made herein without departing from the spirit and scope of the disclosure as defined by the following claims.

What is claimed is:

1. A method for cementing a production casing string disposed within a parent casing to the parent casing and a well bore disposed below the parent casing, comprising:

(a) attaching the production casing string to an anchor;

(b) attaching the anchor to a bottom-hole section of the parent casing;

(c) pulling on the production casing string so as to place the production casing string in tension;

(d) pumping a cement slurry down the production casing string and up into an annulus formed between the production casing string and the parent casing and the annulus between the well bore and production casing below the parent casing; and (e) allowing the cement slurry to set while the production casing string is in tension.

2. The method according to claim 1, further comprising setting slips at the surface so as to hold the production casing string in tension.

3. The method according to claim 2, further comprising detaching the production casing string above the slips once the slips have been set.

4. The method according to claim 1, wherein the anchor is attached to the bottom- hole section of the parent casing string by setting the anchor in the bottom-hole section of the parent casing string with the production casing string.

5. The method according to claim 4, wherein the anchor comprises a body, a lock sleeve disposed around the anchor body, and a wedge disposed around the anchor body adjacent to the lock sleeve and the anchor is set in the bottom-hole section of the parent casing string by activating the lock sleeve to engage with an inner surface of the parent casing string and pulling on the anchor with the production casing string so as to drive the wedge into the lock sleeve thereby fixing the anchor body to the bottom-hole section of the parent casing string.

6. The method according to claim 1, wherein the production casing string is attached to the anchor prior to the anchor being attached to the parent casing string.

7. The method according to claim 6, wherein the anchor is run in a section of parent casing prior to attaching the anchor to the bottom-hole section of the parent casing string.

8. The method according to claim 1, wherein the bottom-hole section of the parent casing string is formed with a plurality of ribs, which aid in binding the bottom-hole section of the parent casing string to the well bore prior to cementing the production casing string to the parent casing string and well bore.

* * * * *